US006398154B1

(12) United States Patent
Cox et al.

(10) Patent No.: US 6,398,154 B1
(45) Date of Patent: Jun. 4, 2002

(54) REEL HAVING DEFORMING ENGAGEMENT OF CORE TO FLANGE

(75) Inventors: Gary L. Cox, Richmond, IN (US); Jack E. Elder, Rochester, MI (US); Chad L. Eversole; Steven A. Dyck, both of Richmond, IN (US)

(73) Assignee: Vandor Corporation, Richmond, IN (US)

( * ) Notice: Subject to any disclaimer, the term of this patent is extended or adjusted under 35 U.S.C. 154(b) by 0 days.

(21) Appl. No.: 09/607,473

(22) Filed: Jun. 30, 2000

Related U.S. Application Data

(60) Provisional application No. 60/142,270, filed on Jul. 2, 1999.

(51) Int. Cl.[7] ..... B65H 75/22

(52) U.S. Cl. ..... 242/608.2; 242/609.1; 242/613.4

(58) Field of Search ..... 242/608, 608.2, 242/608.6, 609, 609.1, 613.4; 156/91

(56) References Cited

U.S. PATENT DOCUMENTS

| | | | | |
|---|---|---|---|---|
| 3,635,421 | A | | 1/1972 | Boland et al. |
| 3,785,584 | A | | 1/1974 | Crellin, Jr. |
| 3,822,841 | A | | 7/1974 | Campbell |
| 3,846,887 | A | * | 11/1974 | Woods et al. |
| 3,958,775 | A | | 5/1976 | Liga |
| 4,002,310 | A | * | 1/1977 | Ganser et al. |
| 4,580,743 | A | | 4/1986 | Bauer et al. |
| 4,715,556 | A | | 12/1987 | Tack et al. |
| 4,895,316 | A | | 1/1990 | Salloum |
| 4,903,913 | A | | 2/1990 | McCaffrey |
| 5,106,031 | A | | 4/1992 | Sanda et al. |
| 5,791,588 | A | * | 8/1998 | Linstrand |
| 5,871,171 | A | | 2/1999 | Kenney et al. |
| 5,931,409 | A | * | 8/1999 | Nulle et al. |
| 5,975,459 | A | * | 11/1999 | Roman |

FOREIGN PATENT DOCUMENTS

FR 2 691 448 A1 * 10/1992

* cited by examiner

*Primary Examiner*—William A. Rivera
(74) *Attorney, Agent, or Firm*—Maginot, Moore & Bowman

(57) ABSTRACT

A reel for supporting wound flexible media includes a core, a first flange and a second flange. The core has a first pliable end and a second end, the first pliable end defining a first cross-sectional shape. The first flange has an outer section and an inner section. The outer section includes an inner rim, the inner rim including a radially inward extending ridge defining at least a portion of a periphery corresponding substantially to the first cross-sectional shape and configured to deformingly engage the first pliable end. The inner section includes an outer rim, the outer rim including a radially outward extending ridge defining at least a portion of a periphery corresponding substantially to the first cross-sectional shape and configured to deformingly engage the first pliable end. The second flange is coupled to the second end.

26 Claims, 9 Drawing Sheets

REEL HAVING DEFORMING ENGAGEMENT OF CORE TO FLANGE

This application claims benefit of appln No. 60/142,270 Jul. 2, 1999.

FIELD OF THE INVENTION

The present invention relates generally to reels for supporting wound flexible media, and in particular, to reels having a core and at least one attachable flange.

BACKGROUND OF THE INVENTION

Reels for supporting wound flexible media are employed to both store and facilitate the dispensing of wound media such as rope, wire, chain, and strings of parts. The essential elements of a reel include its core, around which the flexible media is wound, and its flanges, which prevent the wound flexible media from migrating axially off of the core.

Well-designed reels must combine a high strength to weight ratio with low manufacturing cost. One reel design that has gained popularity for certain applications includes a reel in which the core is constructed of a pressed paperboard material and the flanges are constructed of a composite or plastic material. The use of paper and plastic components, in general, provides a high strength to weight ratio and facilitates the use of relatively straightforward manufacturing techniques. Another lightweight reel design consists of a pressed paperboard core and corrugated paper flanges. While such all-paper reels provide significant economy and light weight, all-paper reels are not suitable for certain medium to heavy duty applications because the paper flanges do not have the strength of plastic, wood, or steel flanges. Accordingly, for medium to heavy duty reel applications, plastic or composite flanges provide an advantageous combination of manufacturability, light weight, and strength.

Reels having composite or plastic flanges are relatively simple to manufacture. The flanges may be formed using injection molding techniques. The flanges are then attached to the core. While the manufacturing process is relatively simple, the labor involved in the reel assembly process nevertheless contributes significantly to the manufacturing cost of the reel. One source of labor cost arises from the process of securing the flanges to the reel.

Flanges have been secured to reels using a number of methods. The selection of an attachment mechanism must balance the need for a secure attachment with low manufacturing cost. The use of staples to attach a plastic flange to a paperboard hub is well-known, and is discussed, for example, in U.S. Pat. No. 5,660,354 to Ripplinger. The drawbacks of stapling include the labor involved with the application of the several staples that are necessary to provide a secure attachment between the flanges and the core.

Other known reel designs include nut and through-bolt assemblies that secure the flanges to the core. These arrangements also require a significant amount of labor in the assembly of the reel, and further incur the material costs of the steel nuts and bolts.

What is needed, therefore, is a method of and arrangement for attaching a flange to a core in a reel assembly that requires less labor than the prior art arrangements, while still providing a secure attachment.

SUMMARY OF THE INVENTION

The present invention fulfills the above needs, as well as others, by providing a flange that has features that deformingly engage a pliable end of the core to secure the core to the flange. More specifically, the flange includes an inward extending ridge and an outward extending ridge that deformingly engage the pliable end of the core. By deformingly engaging the pliable end using inward and outward extending ridges, the pliable end of the core is deformed in opposing directions, thereby securing the pliable end (and the core) to the flange. The resulting reel may thus be formed by advancing the core such that the pliable end advances between the inward and outward extending ridges. As a result, other securing mechanisms, such as bolts or staples need not be used.

An exemplary embodiment of the present invention includes a reel for supporting wound flexible media that comprises a core, a first flange and a second flange. The core has a first pliable end and a second end, the first pliable end defining a first cross-sectional shape. The first flange has an outer section and an inner section. The outer section includes an inner rim, the inner rim including a radially inward extending ridge defining at least a portion of a periphery corresponding substantially to the first cross-sectional shape and configured to deformingly engage the first pliable end. The inner section includes an outer rim, the outer rim including a radially outward extending ridge defining at least a portion of a periphery corresponding substantially to the first cross-sectional shape and configured to deformingly engage the first pliable end. The second flange is coupled to the second end.

An exemplary method according to the present invention includes a method of manufacturing a reel for supporting wound flexible media, the reel including a core having a first pliable end, the first pliable end defining a first cross-sectional shape. The method includes a step of disposing at least a portion of a first flange on a support, the first flange having an outer section and an inner section, the outer section including an inner rim, the inner rim including a radially inward extending ridge having a periphery corresponding substantially to the first cross-sectional shape, and the inner section including an outer rim, the outer rim including a radially outward extending ridge having a periphery corresponding substantially to the first cross-sectional shape. The method further includes the step of advancing the core past the radially outward extending ridge and the radially inward extending ridge such that at least one of the radially outward extending ridge and the radially inward extending ridge deformingly engage the first pliable end. Finally, the method includes the step of securing a second flange to the core.

Accordingly, by employing a flange having inward and outward extending ridges that deformingly engage a pliable end of a core, the method and apparatus of the present invention forms a secure attachment between the flange and the core without separate fasteners such as bolts or staples. Even if supplemental fasteners are used, the reel of the present invention provides a much more secure attachment through the deforming engagement of the ridges and pliable end. In one embodiment, the inner and outer extending ridges are wedge-shaped such that the ridges are tapered from the inside out in the axial direction. The wedge-shaped ridges facilitate movement of the pliable end of the core into a position between the ridges, yet resist movement of the pliable end of the core back out of that position.

The above discussed features and advantages, as well as others, will become more readily apparent to those of ordinary skill in the art by reference to the following detailed description and accompanying drawings.

DETAILED DESCRIPTION

Figure 1:
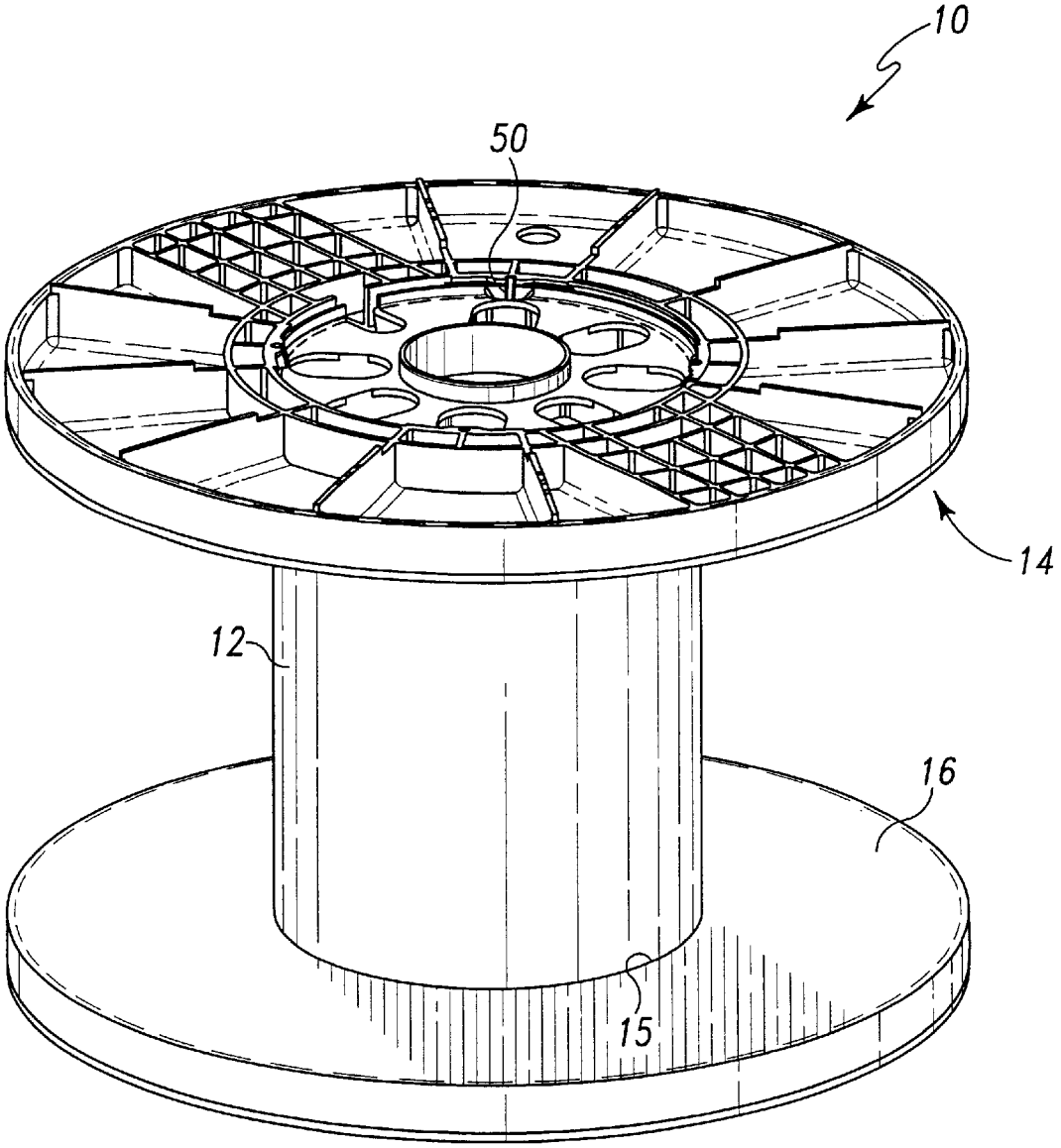
FIG. 1 shows a perspective view of a first exemplary embodiment of a reel according to the present invention.

FIG. 1 shows an exemplary embodiment of a reel 10 according to the present invention which includes a core 12, a first flange 14 and a second flange 16. The core 12 has a first pliable end 13 (see FIG. 7) and a second end 15. The first pliable end 13 has a first cross-sectional shape, which in the exemplary embodiment discussed herein is a circular cross-sectional shape. It is noted that the core 12 typically, but not necessarily, has a substantially uniform cross-sectional shape. In the exemplary embodiment described herein, the core 12 comprises a pressed paperboard tube.

Figure 2:
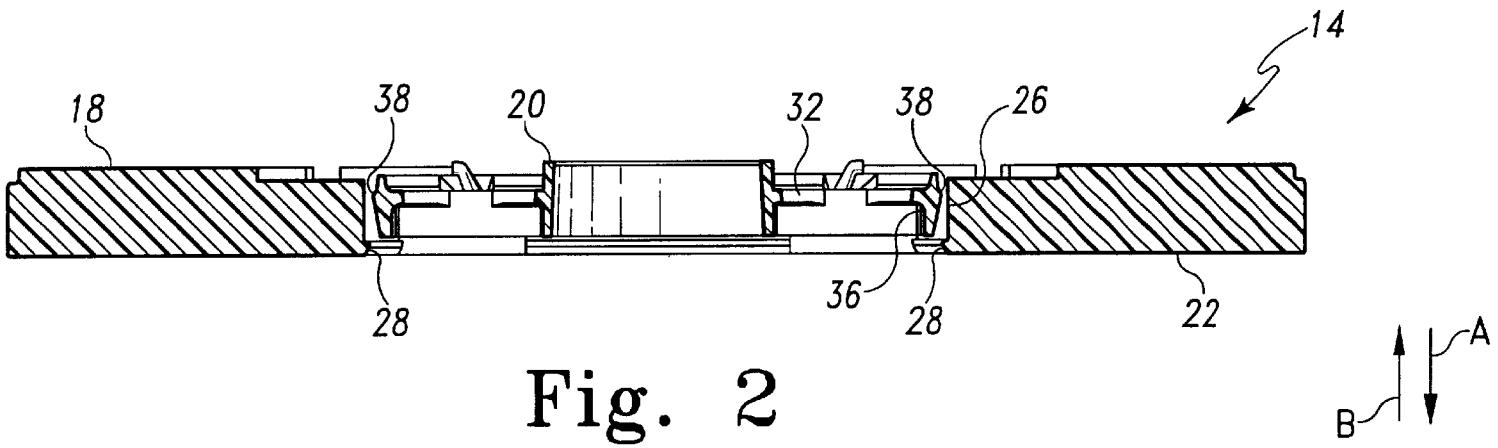
FIG. 2 shows a cutaway cross-sectional view of a flange of the reel of FIG. 1 wherein the flange is removed from the core of the reel.
Figure 3:
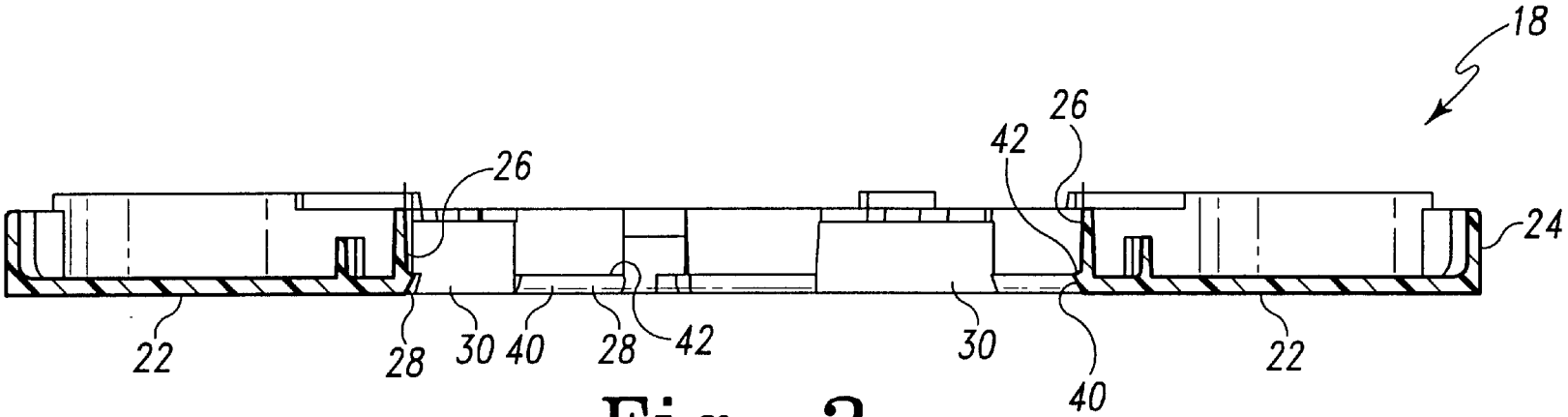
FIG. 3 shows a cutaway cross-sectional view of the outer section of the flange of FIG. 2 wherein the outer section is removed from the inner section of the flange.
Figure 4:
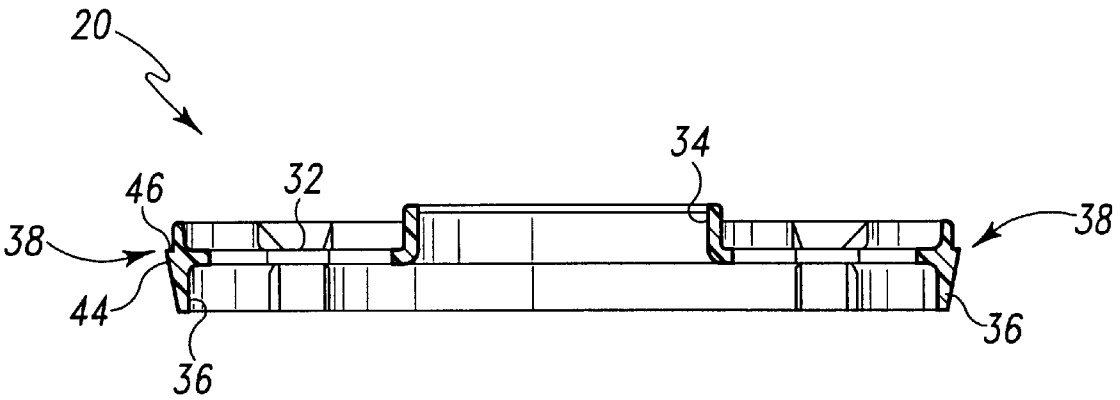
FIG. 4 shows a cutaway cross-sectional view of an inner section of the flange of FIG. 2 wherein the inner section is removed from the outer section of the flange.
Figure 5:
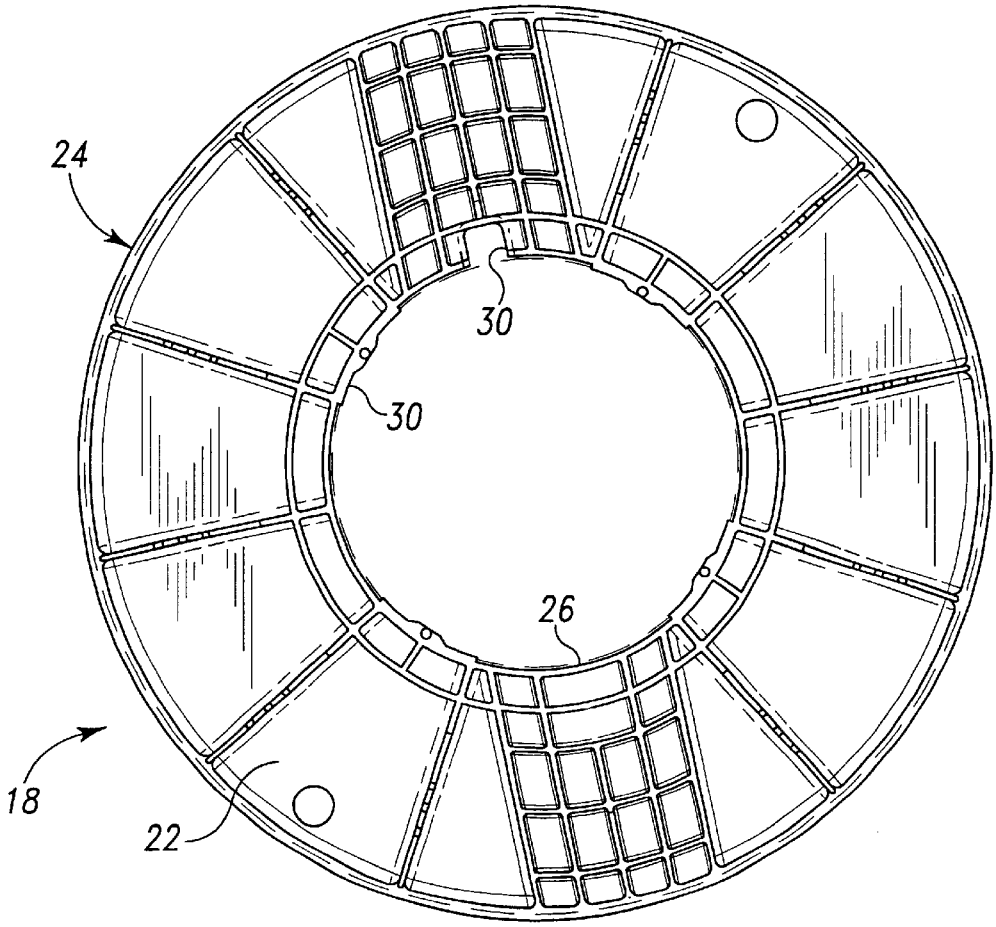
FIG. 5 shows a plan view of the outer section of the flange of FIG. 2 wherein the outer section is removed from the inner section of the flange.
Figure 6:
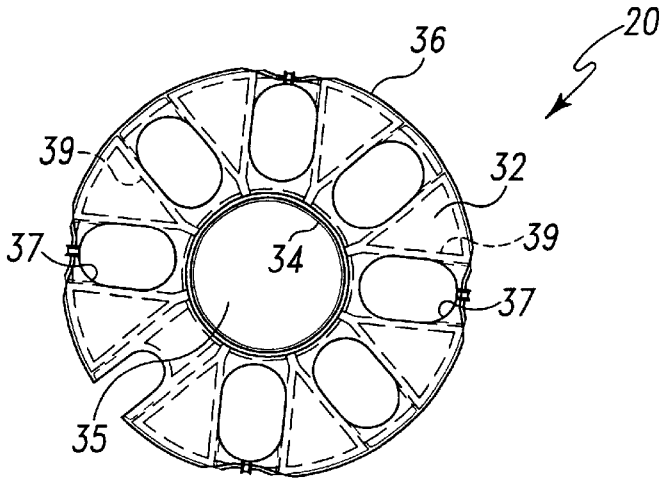
FIG. 6 shows a plan view of the inner section of the flange of FIG. 2 wherein the inner section is removed from the outer section of the flange

As shown in FIGS. 1 and 2, the first flange 14 includes an outer section 18 (see also FIG. 3) and an inner section 20 (see also FIG. 4). The outer section 18 and the inner section 20 are preferably molded of a plastic or composite material. However, metal and other rigid materials may be used while still retaining many of the advantages of the present invention. In the exemplary embodiment of FIGS. 1–7, the outer section 18 and the inner section 20 are separate, distinct structures.

With reference to FIGS. 1, 2, and 3, the outer section 18 includes a main retaining member 22, an outer rim 24, and an inner rim 26. The retaining member 22 provides the structure to support and retain wound flexible media when it is loaded onto the core 12. The outer rim 24 extends axially from the outer periphery of the main retaining member 22 and the inner rim 26 extends axially from the inner periphery of the main retaining member 22.

The shape of the inner rim 26 corresponds to the first cross-sectional shape, i.e., the shape of the first pliable end 13 of the core 12. The inner rim 26 has a shape that corresponds to the shape of the first pliable end 13 because, as discussed more fully below, the inner rim 26 forms a boundary of a channel in which the first pliable end 13 is retained. (See FIG. 7). In the exemplary embodiment described herein, the main retaining member 22 defines an annulus such that the outer rim 24 and the inner rim 26 are substantially circular. It will be noted however, that the exact shapes of the outer rim 24 and the retaining member 22 are a matter of design choice.

Figure 7:
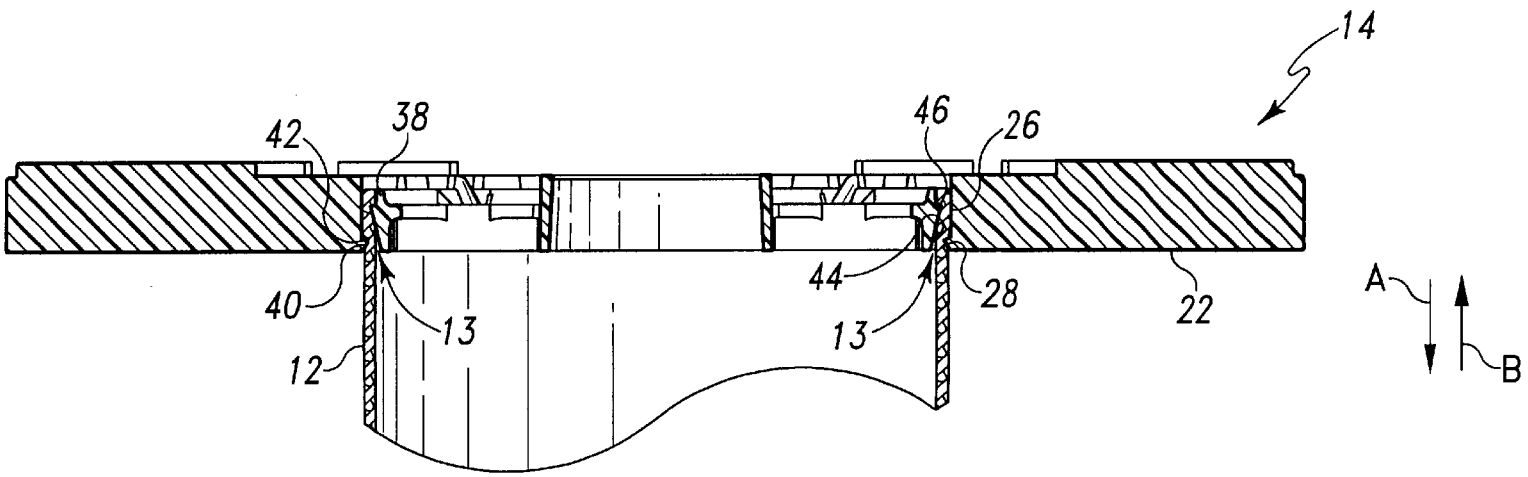
FIG. 7 shows an enlarged, partial, cutaway cross-sectional view of the reel of FIG. 1.

The inner rim 26 includes a radially inward extending ridge 28 defining at least a portion of a periphery corresponding substantially to the first cross-sectional shape. As shown in FIG. 7, the radially inward extending ridge 28 is configured to deformingly engage the first pliable end 13 of the core 12. In other words, when the reel 10 is assembled, the first pliable end 13 is deformed around the radially inward extending ridge 28.

The radially extending ridge 28, while generally defining a periphery corresponding to the first cross-sectional shape, may comprise broken segments of a theoretically continuous periphery, such as is shown in FIG. 3. In particular, drive holes, feeder holes, and/or other design features of the flange 14, which are known to those of ordinary skill in the art, create breaks, such as the breaks 30, in the periphery defined by the radially inward extending ridge 28. Such breaks 30 typically also interrupt the continuity of the inner rim 26 itself.

The cross section of the radially inward extending ridge 28 is preferably tapered, or wedge-shaped, to assist in assembly of the reel 10. In particular, as discussed below the wedge shape of the radially inward extending ridge 28 facilitates movement of the core 12 in the direction B, as is needed to assemble the reel 10, and inhibits movement of the core 12 in the direction A, thereby securing the core 12 to flange 14.

To this end, as shown in FIG. 3, the radially inward extending ridge 28 includes a first face 40 and a second face 42. The first face 40 extends from the inner rim 26 at a first angle with respect to the radial plane. The second face 42 extends from the inner rim 26 at a second angle with respect to the radial plane. As shown in FIGS. 3 and 7, the first face 40 is axially inward from the second face 42 with respect to the core 12. The first angle is greater than the second angle, thereby defining the wedge-shape of the radially inward extending ridge 28. Thus, the second face 42 extends in a direction that has less of an axial component than the direction in which the first face 40 extends. As a result, the first face 40 provides a more tapered axial path interruption than the second face 42. Because the axial path interruption introduced by the first face is more tapered, the core 12 is more easily advanced in the direction B (from the first face 40 to the second face 42), as when the reel 10 is assembled, than in the direction A (from the second face 42 to the first face 40), as when the reel 10 would be broken apart.

The inner section 20 comprises a hub-like structure defined by a main body 32, and arbor rim 34, and an outer rim 36. The arbor rim 34 defines an arbor opening 35 in the inner section 20. The arbor opening 35 cooperates with a like arbor opening on the other flange 16 of the reel 10 to allow rotation of the reel 10 about a central axle, not shown.

The main body 32 in the exemplary embodiment is generally disk-shaped, and may include typical features of a reel hub, such as drive holes 37, support ribs 39 and/or other features. In accordance with the present invention, the outer rim 36 includes a radially outward extending ridge 38 defining at least a part of a periphery corresponding substantially to the first cross-sectional shape. The radially outward extending ridge 38 is thus configured to deformingly engage the first pliable end 13 (see FIG. 7).

Similar to the radially inward extending ridge 28, the radially outward extending ridge 38 is preferably wedge-shaped. To this end, the radially outward extending ridge 38 includes a third face 44 and a fourth face 46. The third face 44 is axially inward from the fourth face 46 with respect to the core 12 (see FIG. 7). The third face 44 extends from the outer rim 36 at a third angle with respect to the radial plane and the fourth face 46 extends from the outer rim 36 at a fourth angle with respect to the radial plane. Similar to the first angle of the first face 40 and the second angle of the second face 42, the third angle is greater than the fourth angle. Because the third angle is greater than the fourth angle, the core 12 is more easily advanced in the direction B than in the direction A. As a result, less force is required to assemble the reel 10 than to break apart the reel 10.

As shown in FIG. 7 the radially inward extending ridge 28 and the radially outward extending ridge 38 deform the core 12 in opposing directions, thereby grasping the core 12 therebetween. The core 12 resists movement in the direction A by any number of physical characteristics.

For example, the wedge-shaped nature of the first face 40 and the second face 42, as well as the wedge-shaped nature of the third face 44 and the fourth face 46 may create in some embodiments a barbing engagement between the core 12 and the ridges 28 and 38. For example, if the second angle and the fourth angle are substantially zero, then the ridges 28 and 38 may provide a barbing engagement with the core 12. In such embodiments the ridges 28 and 38 tend to dig into the material of the core 12, for example, paperboard, to help inhibit movement of the core 12 in the direction A with respect to the flange 14. The deforming engagement of the core 12 in opposing directions by the ridges 28 and 38 enhance the digging retention force.

Another physical characteristic that may help inhibit movement of the core 12 in the direction A arises from the configuration of the outer section 18 and the inner section 20 as separate distinct components. Because the outer section 18 and the inner section 20 are separate components, they are capable of relative axial movement with respect to each other. The primary force that would cause relative axial movement of the outer section 18 and the inner section 20 is the axially outward force of the payload (not shown) against the retaining member. Such force tends to urge the outer section 18 in the direction A relative to the inner section 20. As the outer section 18 is urged in the direction A, the ridges 28 and 38 clamp or pinch the first pliable end 13. Such clamping and pinching further inhibits axial movement of the core 12 in the direction A. Accordingly, the use of an outer section 18 and an inner section 20 that are capable of relative movement may provide enhanced integrity of the core 12 to the flange 14.

It is noted that while only the first flange 14 is discussed above in detail, the second flange 16 may suitably have the same structure.

Thus, the above described embodiment of the present invention provides an advantage of a secure interconnection between the flanges 14 and 16 resulting from the deformation of the first pliable end 13 of the core 12 by the opposing ridges 28 and 38. Another advantage of the invention is the reduced labor requirements in manufacturing the reel 10. The combination of the provision of a secure attachment with reduced labor requirements desirably reduces the relative cost of the reel 10 as compared to reels of similar strength using staples or the like.

The reduced labor requirements discussed above will become more readily apparent by reference to the method of manufacturing the reel 10, discussed below. However, it will be appreciated that at least some of the advantages of the present invention may be realized even if other methods of manufacture are implemented.

In any event, to manufacture the reel 10 in accordance with a first exemplary method according to the present invention, the outer section 18 and the inner section 20 of the flange 14 are formed as two separate pieces. To this end, the outer section 18 and the inner section 20 are preferably molded as a single piece using single mold (not shown). To this end, the mold design may include breakaway connectors 50 that allow the outer section 18 and the inner section 20 to be separated after molding. Such molding techniques are well-known. Alternatively, the outer section 18 and the inner section 20 of the reel may be separately molded.

In accordance with the method, once the outer section 18 and the inner section 20 are formed, the outer section 18 is preferably disposed on a support and the first pliable end 13 of the core 12 is advanced into the outer section 18, or in other words, past the radially inward extending ridge 28. The inner section 20 is thereafter inserted into the first pliable end 13 of the core 12, such that, in a relative manner, the first pliable end 13 is advanced past the radially outward extending ridge 38.

The second flange 16 may suitably be assembled to the core 12 in the same manner.

It will be appreciated that those of ordinary skill in the art may modify the above exemplary method such that the core 12 is secured to the first flange 14 and the second flange 16 contemporaneously. For example, a hydraulic or robotic fixture may be configured to secure the core 12 to both flanges 14 and 16 contemporaneously. Such a modification can shorten the production cycle, but can require more costly equipment.

Figure 8:
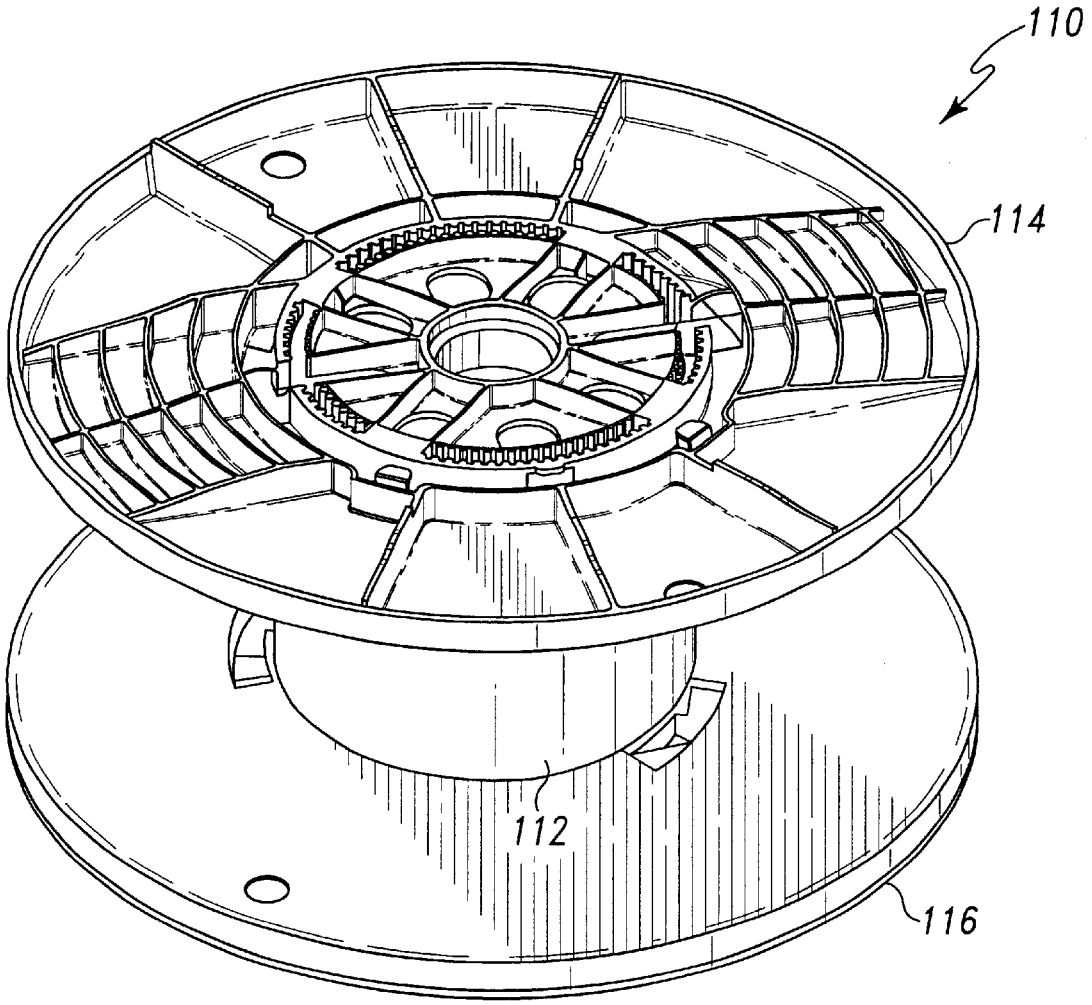
FIG. 8 shows a perspective view of a second exemplary embodiment of a reel according to the present invention.
Figure 9:
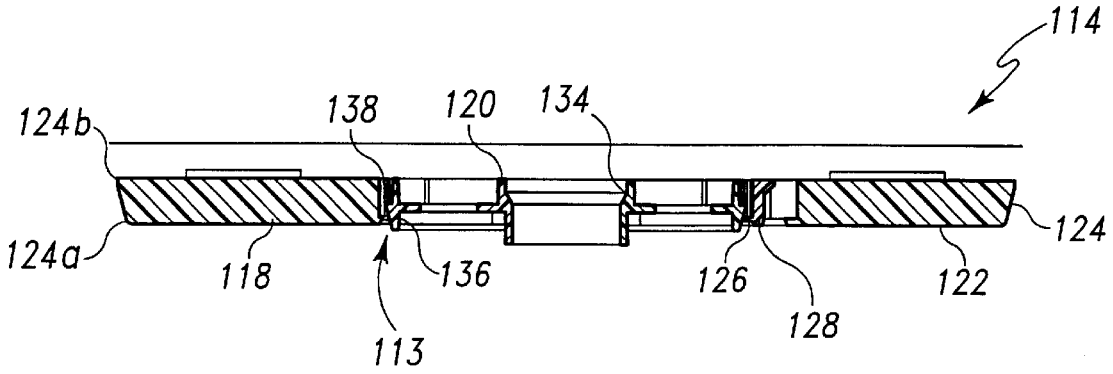
FIG. 9 shows a cutaway cross-sectional view of a flange of the reel of FIG. 2 wherein the flange is removed from the core of the reel.
Figure 10:
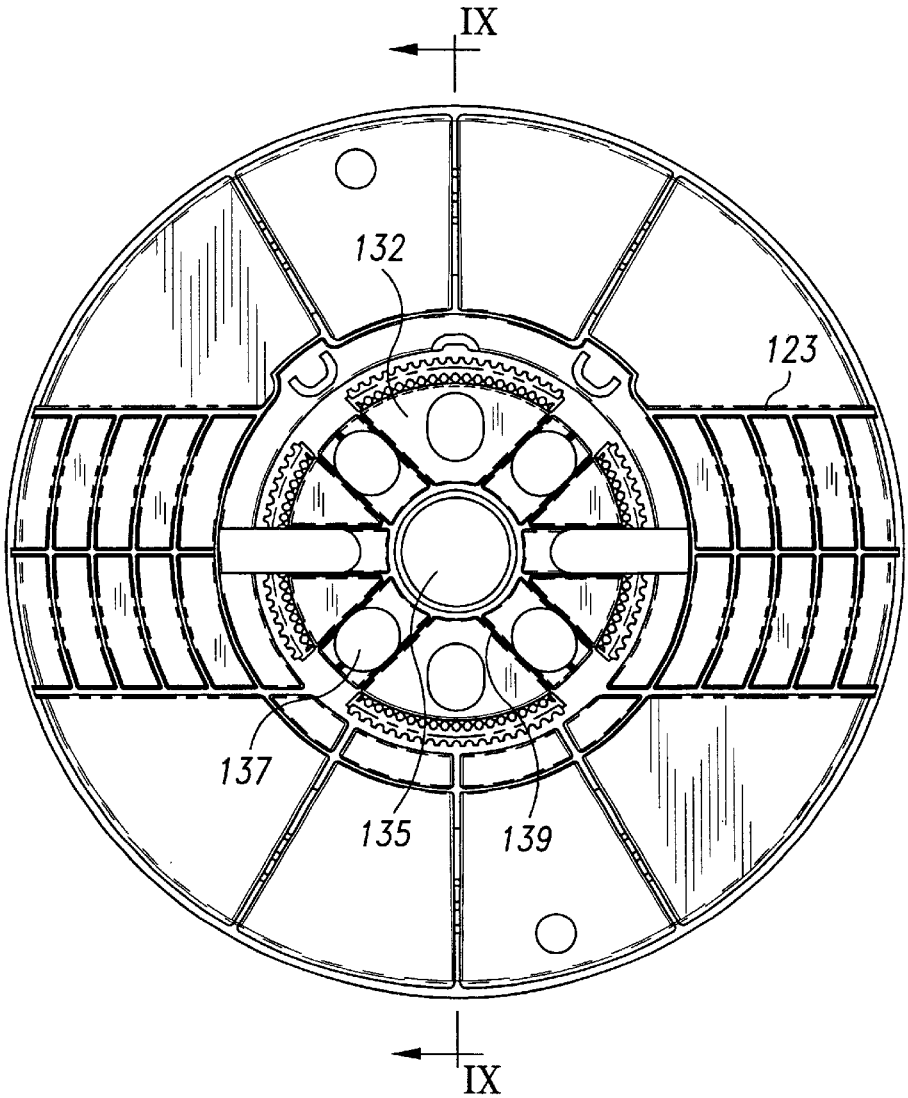
FIG. 10 shows a plan view of the flange of FIG. 2.

In an alternative embodiment of the present invention, the flanges are constructed of a single, integral member. FIGS. 8 through 10 show such an embodiment of the present invention. While use of single piece flanges eliminates some of the binding or pinching phenomena associated with use of separately movable flange sections (e.g. inner section 20 and outer section 18 discussed above), the single piece flange design has other structural advantages inherent to a single piece design. For example, it has been observed that the single piece flange design can perform better in drop tests.

FIG. 8 shows an exemplary embodiment of a reel 110 according to the present invention which includes a core 112, a first flange 114 and a second flange 116. The core 112 may suitably have the same structure as the core 12 of FIG. 1. Accordingly, the core 112 has a first pliable end and a second end similar to the first pliable end 13 and second end 15 of FIGS. 1 and 7. Similar to the reel 10 of FIG. 1, the first pliable end 113 has a first cross-sectional shape, which in the exemplary embodiment discussed herein is a circular cross-sectional shape.

Referring generally to FIGS. 8–10, the first flange 114 includes an outer section 118 and an inner section 120. The outer section 118 and the inner section 120 are preferably molded of a plastic or composite material. However, metal and other rigid materials may be used while still retaining many of the advantages of the present invention. In the exemplary embodiment of FIGS. 8–10, the outer section 118 and the inner section 120 are formed as integral structures.

The outer section 118 includes a main retaining member 122, an outer rim 124, and an inner rim 126. The retaining member 122 provides the structure to support and retain wound flexible media when it is loaded onto the core 112. The outer rim 124 in the exemplary embodiment described herein constitutes a tapered outer rim 124. The tapered outer rim extends both axially and radially from the outer periphery of the retaining member 122. In particular, the tapered outer rim 124 has an intersecting circumference 124*a* that intersects the outer periphery of the retaining member 122 and extends radially and axially from that point to an end circumference 124*b*. Because it extends both axially and radially, as opposed to substantially only radially like the outer rim 24 of the embodiment of FIGS. 1–7, the tapered outer rim 24 provides additional advantages.

In particular, reels are preferably designed to withstand some degree of mishandling, including the impact from being dropped. To this end, plastic reel flanges often include reinforcement ribs or the like. For example, the retaining member 122 includes a plurality of reinforcement ribs 123. However, a loaded reel, including those that employ reinforced plastic flanges, will fail if dropped from at or above some height limit that may be measured. Reels having non-tapered outer rims, such as for example, the reel 10 described above, often exhibit failure modes in which a fracture propagates through much or all of the radius of the retaining member 22 to the core 12. Such a failure mode is particularly undesirable because the payload may be difficult to pay out, or may become damaged during pay out, from a heavily fractured retaining member 22.

The tapered outer rim 124 of the reel 110 of FIGS. 8–10, however, provides for a more advantageous failure mode. In particular, if the reel 110 is dropped, then the impact forces are focussed on the end circumference 124*b* of the tapered outer rim 124 (or, depending on the tilt of the reel, the end circumference of the tapered outer rim of the second flange 116. Because the impact forces are focussed on the end circumference 124*b*, a torque force is generated about the moment arm defined by the tapered outer rim. These torque forces tend to cause the flange 114 to fail at the intersecting circumference 124*a*. In other words, part of the tapered outer rim 124 tends to snap off. It has been observed that failures at the intersecting circumference 124*a* due to the torque forces on the end circumference 124*b* tend to remain isolated near the outer circumference of the flange 114. In other words, fractures resulting from such failures have less of a tendency to propagate toward the center of the flange 114. The failures have less of a tendency to propagate because when the tapered outer rim 124 snaps off, it absorbs much of the impact energy.

By contrast, flanges with non-tapered outer rims are more likely to absorb impacts closer to the intersection of the outer rim and the retaining member. Such impacts do not generate the same torque forces about the moment armed formed by the outer rim. As a result, the impact forces are not as likely to cause the rim itself to snap off and thus absorb the impact energy. The unabsorbed impact energy is thus more likely to cause fractures that extend well inward from the outer edge of the flange.

Accordingly, the rim 124 according to the present invention, which extends both axially and radially from the flange 114, assists in reducing the severity of impact failures by reducing the tendency of impact failures to tend to propagate toward the center of the flange. It is noted that it the rim does not necessarily have to have the shape as shown, extending in a linear fashion between the intersecting circumference 124*a* and the outer circumference 124*b*. Alternative embodiments that extend in a step-wise or arcuate manner may be employed, provided that such embodiments nevertheless employ a rim that extends both axially and radially away from the end of the flange.

Referring again to the general description of the flange 114, the shape of the inner rim 126 corresponds to the first cross-sectional shape, i.e., the shape of the first pliable end of the core 112. The inner rim 126 has a shape the corresponds to the shape of the first pliable end 113 because, similar to the inner rim 26 of the embodiment of FIGS. 1–7, the inner rim 126 forms a boundary of a channel 113 in which the first pliable end is retained.

The inner rim 126 includes a radially inward extending ridge 128 defining at least a portion of a periphery corresponding substantially to the first cross-sectional shape. As with the embodiment of FIGS. 1–7, the radially inward extending ridge 128 is configured to deformingly engage the first pliable end of the core 112. In other words, when the reel 110 is assembled, the first pliable end is deformed around the radially inward extending ridge 128. It is noted that as with the ridge 28, the radially extending ridge 128 may actually comprise broken segments of a theoretically continuous periphery.

The cross section of the radially inward extending ridge 128 is preferably tapered, or wedge-shaped, to assist in assembly of the reel 110. To this end, as shown in FIG. 9, the radially inward extending ridge 128 has a structure substantially identical to the radially inward extending ridge 28 of the embodiment of FIGS. 1–7, discussed above.

The inner section 120 comprises a hub-like structure defined by a main body 132, and arbor rim 134, and an outer rim 136. The arbor rim 134 defines an arbor opening 135 in the inner section 120. The arbor opening 135 cooperates with a like arbor opening on the other flange 116 of the reel 110 to allow rotation of the reel 110 about a central axle, not shown.

The main body 132 in the exemplary embodiment is generally disk-shaped, and may include typical features of a reel hub, such as drive holes 137, support ribs 139 and/or other features. In accordance with the present invention, the outer rim 136 includes a radially outward extending ridge 138 defining at least a part of a periphery corresponding substantially to the first cross-sectional shape. The radially outward extending ridge 138 is thus configured to deformingly engage the first pliable end of the core 112.

Similar to the radially inward extending ridge 128, the radially outward extending ridge 138 is preferably wedge-shaped. To this end, the radially outward extending ridge 138 is substantially identical in structure to the radially outward extending ridge 38 of FIGS. 2, 4, 7.

In general, the radially inward extending ridge 128 and the radially outward extending ridge 138 deform the core 112 in opposing directions, thereby grasping the core 112 therebetween. The core 112 resists movement in the direction A by any number of physical characteristics, including friction. The deforming of the core 112 may or may not involve actually penetrating the surface of the core.

The embodiment of FIGS. 8 through 10 thus provides many of the same advantages as those associated with the embodiment of FIGS. 1 through 7. However, the use of a single, unitary flange design in the reel 110 may reduce manufacturing costs by reducing the number of steps required for assembly. However, the embodiment wherein the flange is a two-part design comprising an inner section and a separate outer section such as shown in FIGS. 1 through 7 may be capable of greater flange retention strength due to the relative movement that is possible between the two sections.

In any event, an exemplary method of manufacturing the reel 110 is provided herebelow. The flanges 114 and 116 are first generated. To this end, the outer section 118 and the inner section 120 of the first flange 114 are injection molded as a single piece. The second flange 116 is preferably generated in the same manner. In the exemplary method described herein, the outer section 18 and the inner section 20 of the first flange 14 are molded as a single connected piece. Alternatively, if metal flanges are used, normal metal forming techniques may be employed.

After the first flange 114 is generated, the first flange 114 is preferably disposed on a support, not shown. Then, the core 112 is advanced past the radially inward extending ridge 128 and the radially outward extending ridge 138 such that at least one of the radially inward extending ridge 128 and the radially outward extending ridge 138 deformingly engage the first pliable end 113. The second flange 116 may suitably be assembled to the core 112 in the same way.

Figure 12:
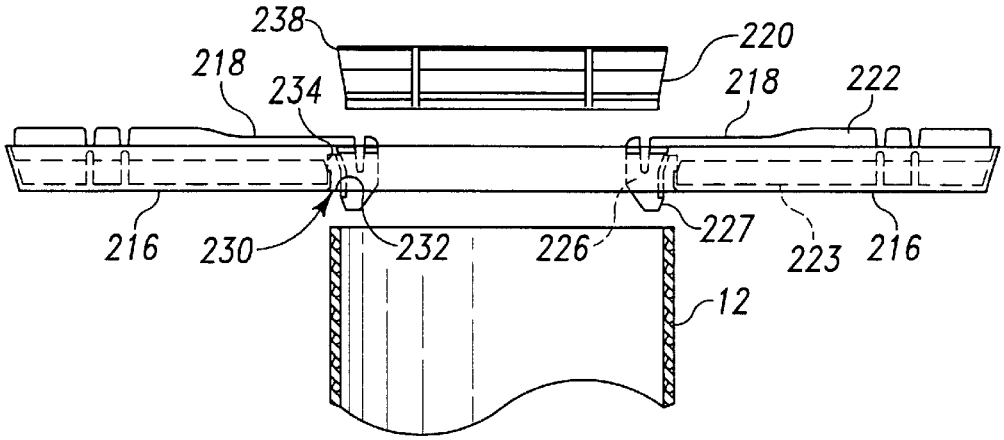
FIG. 12 shows an exploded view of the reel of FIG. 11.
Figure 11:
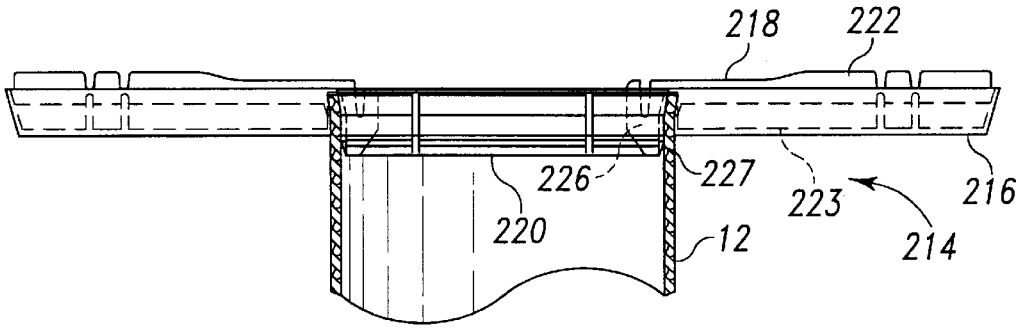
FIG. 11 shows a fragmentary plan view of a third exemplary embodiment of a reel according to the present invention, with the core shown in cross section.
Figure 13:
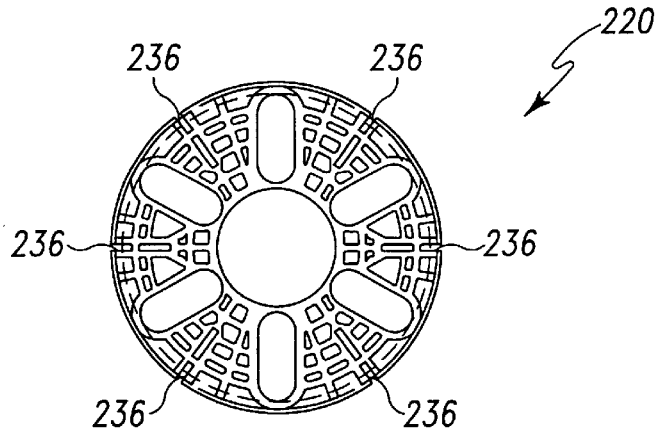
FIG. 13 shows a top plan view of a plug of the reel of FIG. 11.

FIGS. 11–15 show a third embodiment of a flange 214 according to the present invention. The flange 214 may readily replace the flange 14 of the reel 10 in FIG. 1. The flange 214 has a particularly secure attachment to the core. As shown in FIGS. 11, 12, and 13, the flange 214 includes a flange body 216, a plurality of flange films 218, and a plug 220.

In particular, FIG. 11 shows the flange 214 assembled onto the core 12. The flange 214 is shown in a side plan view with hidden features shown as dashed lines. The core 12 is shown as a partial section. FIG. 12 shows the flange 214 and the core 12 in a view similar to FIG. 11. However, in FIG. 12, the plug 220 is separated from the flange body 216 and flange fins 218, and the core 12 is separated from the all of the components of the flange 214. FIG. 13 shows a top plan view of the plug 220.

Figure 14:
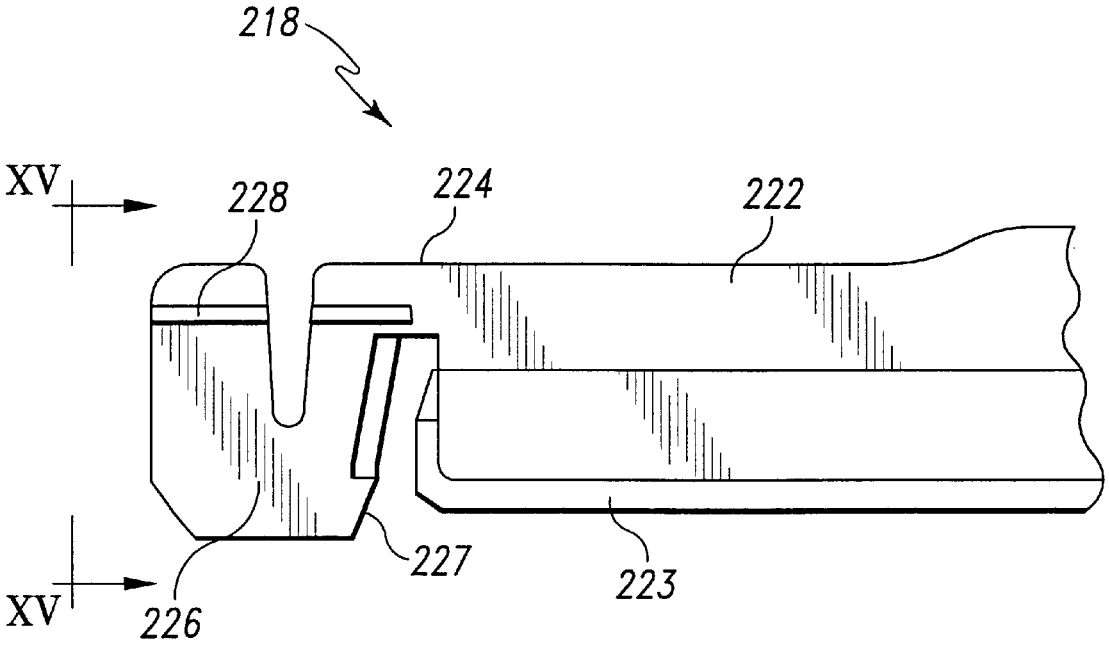
FIG. 14 shows a fragmentary plan view of a flange fin of the reel of FIG. 11.
Figure 15:
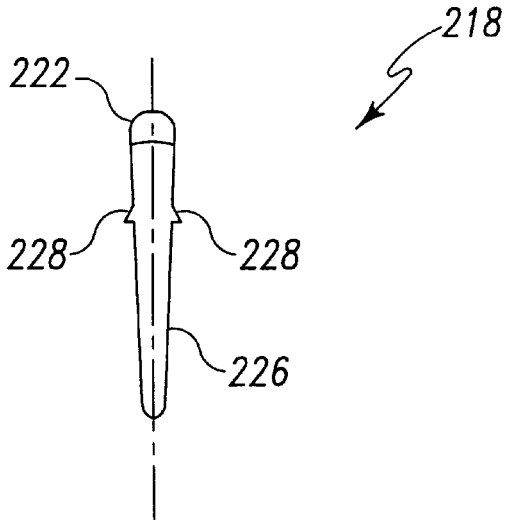
FIG. 15 shows a plan view of the flange fin of FIG. 14 taken along view 15—15 of FIG. 14.

The plurality of flange fins 218 are secured to the flange body 216 and are preferably integrally molded therewith. FIGS. 14 and 15 show in further detail a flange fin 218 apart from the remainder of the flange 214. The flange fin 218 includes a rib 222 that is secured on a first end 223 to the flange body 216 (see FIGS. 11 and 12) and extends axially from the flange body 216. The rib 222 further extends radially to a position 224 at which the core 12 will roughly align. Radially inward from the position 224, the flange fin 218 in the exemplary embodiment includes an axially inward extension 226. The axially inward extension 226 further defines a wedge-shaped ridge 227 that is configured to engage, and preferably to deformingly engage, an inner surface of the core 12. (See FIG. 11). The axially inward extension 226 further includes side barbs 228.

The flange body 216 may suitably include the main features of either of the outer sections 18 and 118 of the embodiments described further above. However, the flange body 216 includes the following differences. While the flange body 216 includes an inner rim 230 having a radially inward extending ridge 232, the inner rim 230 further includes an annular channel 234 for receiving the deformed end of the core 12. Moreover, secured to the flange body 216 are a plurality of flange fins 218 as described above. The axially inward extensions 226 of the flange fins 218, which extend radially inward of the position 224, align with extension slots 236 in the plug 220 (See FIG. 13).

The plug 220 has a cross sectional shape with respect to the top view that corresponds to the cross section of the core 12. Thus, for example, the plug 220 has a generally circular shape in the embodiment described herein. However, the plug 220 has a diameter that tapers inward from top to bottom. The outer diameter at the top of the plug 220 preferably exceeds the inner diameter of the core 12. The portion of the plug 220 near the top thereby forms a radially outward extending ridge 238 that deformingly engages the core 12. (See FIG. 11). In fact, when the plug 220 is inserted, the radially outward extending ridge 238 forces the pliable end of the core 12 into the annular channel 234.

Moreover, when the plug 220 is inserted, the plug 220 is retained in position (as shown in FIG. 11) in part by the side barbs 228. In particular, the side barbs 228 engage the top of the plug 220 to assist in axially retaining the plug 220 from migrating axially out of the flange 214. in position as shown in FIG. 11.

It is noted that in the above embodiment, the outer section is the flange body 214 and the inner section may be thought of as the plug 220 and/or the axially inward extensions 226 of the flange fins 218.

Figure 17:
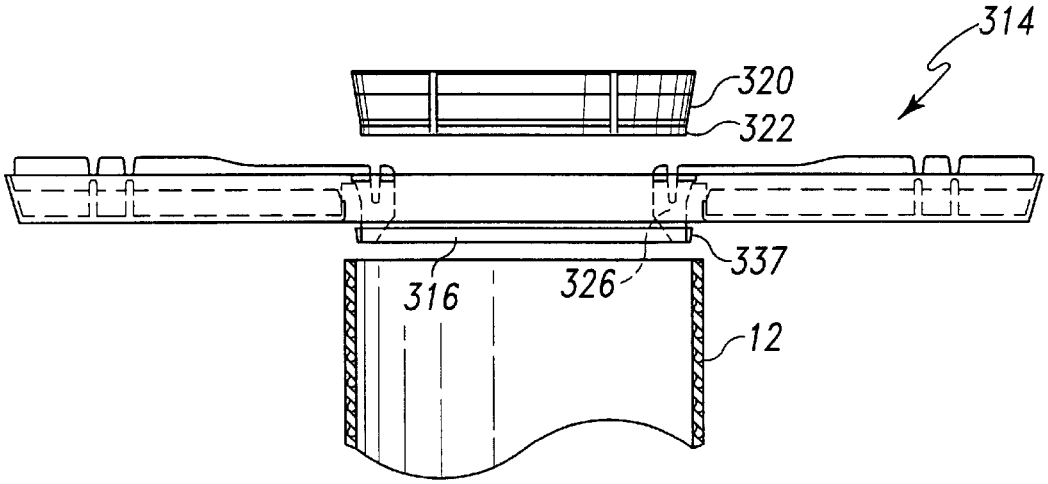
FIG. 17 shows an exploded fragmentary view of the reel of FIG. 16.
Figure 16:
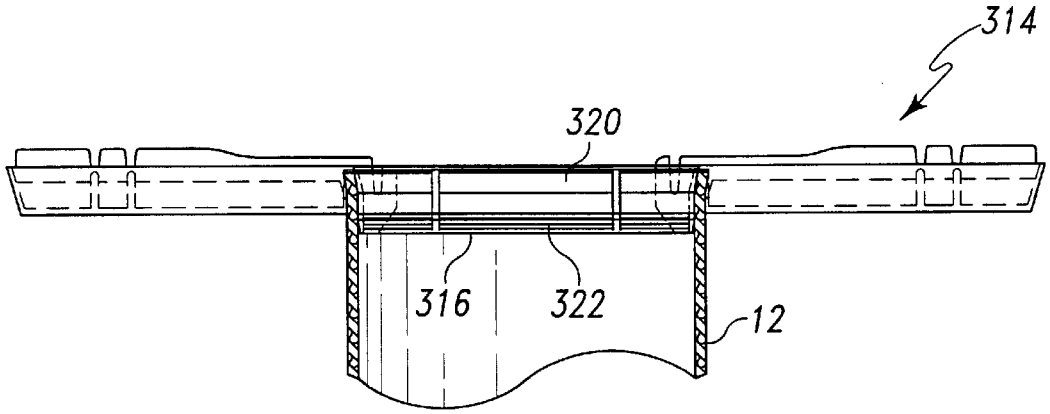
FIG. 16 shows a fragmentary plan view of a fourth exemplary embodiment of a reel according to the present invention with the core shown in cross section.

FIGS. 16 and 17 show yet another alternative of a flange 314 for use in a reel according to the present invention. The flange 314 is identical to the flange 214 except that the flange 314 has a support ring 316 that extends in a substantially annular manner between the wedge-shaped ridges 337 of the axially inward extensions 326 of the flange fins 318. Preferably, the support ring 316 is configured such that insertion of the plug 320 of the flange 314 urges at least a part of the support ring 316 radially outward to engage and/or deformingly engage the inner surface of the core 12. (See FIG. 16).

To allow the support ring 316 to expand radially outward, various implementations may be used. First, the support ring 316 may actually form a segmented ring defined by a plurality of arc segments. In such a case, the bottom portion 322 of the plug 320, which has a outer diameter greater than the inner diameter of the support ring, causes each of the arc segments to bend radially outward into the inner surface of the core 12. In other implementations, the support ring 316 may form a continuous ring. For example, in one implementation, the bottom portion 322 of the plug 320 is non-circular (or more generally, does not coincide completely with the shape of the support ring 316), but instead has one or more areas in which the diameter of the bottom portion 322 exceeds the support ring 316, and one or more compensation areas in which the diameter of the bottom portion 322 is less than the support ring 316. Thus, when the plug 320 is inserted, the bottom portion 322 urges certain portions of the support ring 316 radially outward into the inner surface of the core 12 while allowing other portions of the support ring 316 to collapse or cord off to make the necessary slack. In yet another implementation, the bottom portion 322 of the plug 320 is generally the same shape as the support ring 316 and has a greater diameter in order to force the support ring 316 radially outward in all directions. To allow the support ring 316 to move radially outward in all directions, the support ring 316 is preferably constructed of a material that has some flexibility/stretchability to it. One suitable material would be an olefin material.

The support ring 316 may include a plurality of bumps, detents or ridges, not shown that engage the inner surface of the core 12 to assist in preventing rotation of the core 12 with respect to the flange 314. The support ring 316 preferably has a wedge-shaped profile such that it acts as an annular extension of the wedge-shaped ridges 337 of the axially inward extensions 326 of the flange fins 318. In any event, the use of the support ring 316 helps further secure the core 12 to the flange 314, and further prevents rotation of the core 12 with respect to the flange 314.

It will be appreciated that the above described embodiments are merely exemplary, and that those of ordinary skill in the art may readily devise their own implementations that incorporate the principles of the present invention and fall within the spirit and scope thereof. For example, the shapes and signs of the outer section and inner section of the flange according to the present invention may readily be modified without departing from the spirit of the invention, as long as the inner and outer sections feature opposing ridges that deformingly engage a pliable end of a core.

Moreover, it is noted that the inner rim 26 of the outer section 18 of the first flange 14 of FIG. 1 need not necessarily be the radially inner most part of the outer section. It is contemplated that the outer section 18 could include an annular overhang that extends radially inward over portions of the inner section 20. Likewise, the inner section 20 could conceivably include an overhang that extends radially outward from the outer rim 36 over portions of the outer section 18.

It is also possible that for certain heavy duty applications, staples or other fasteners may be used to reinforce the attachment between the flange and the core according to the present invention. Such an embodiment may still realize some of the advantages of the present invention by potentially reducing the number of such fasteners required to achieve the same strength attachment as that provided by a reel that does not incorporate the deformingly engaging ridges of the present invention.

We claim:

1. A reel for supporting wound flexible media, the reel comprising:

a) a core having a first pliable end and a second end, the first pliable end defining a first cross-sectional shape;

b) a first flange having an outer section and an inner section, the outer section including an inner rim, the inner rim including a radially inward extending ridge defining at least a portion of a first periphery corresponding substantially to the first cross-sectional shape and configured to deformingly engage the first pliable end, and the inner section including an outer rim, the outer rim including a radially outward extending ridge defining at least a portion of a second periphery corresponding substantially to the first cross-sectional shape and configured to deformingly engage the first pliable end; and c) a second flange coupled to the second end.

2. The reel of claim 1 wherein the first pliable end defines a substantially circular cross-sectional shape.

3. The reel of claim 1 wherein the first pliable end is constructed of paperboard.

4. The reel of claim 1 wherein the radially inward extending ridge has a wedge-shaped cross section.

5. The reel of claim 4 wherein the said radially inward extending ridge includes a first face and a second face, the first face extending from the outer flange portion at a first angle with respect to a radial plane, the second face extending from the outer flange portion at a second angle with respect to the radial plane, and wherein the first face is axially inward from the second face with respect to the core, and wherein the first angle is greater than the second angle.

6. The reel of claim 5 wherein the second angle is substantially zero.

7. The reel of claim 1 wherein each of the radially inward extending ridge and the radially outward extending ridge has a wedge-shaped cross section.

8. The reel of claim 1 wherein the first flange is constructed of molded plastic.

9. The reel of claim 1 wherein the inner section and the outer section are integrally formed.

10. The reel of claim 1 wherein the inner section and the outer section comprise separate components.

11. A flange for use in a reel for supporting wound flexible media, the reel including a core having a first pliable end, the first pliable end defining a first cross-sectional shape, the flange comprising:

an outer section including an inner rim, the inner rim including a radially inward extending ridge defining at least a portion of a first periphery corresponding substantially to the first cross-sectional shape and configured to deformingly engage the first pliable end; and an inner section including an outer rim, the outer rim including a radially outward extending ridge defining at least a portion of a second periphery corresponding substantially to the first cross-sectional shape and configured to deformingly engage the first pliable end.

12. The flange of claim 11 wherein the pliable end defines a substantially circular cross-sectional shape and the inner rim and the outer rim have substantially circular cross sections.

13. The flange of claim 11 wherein the radially inward extending ridge has a wedge-shaped cross section.

14. The reel of claim 13 wherein the said radially inward extending ridge includes a first face and a second face, the first face extending from the outer flange portion at a first angle with respect to a radial plane, the second face extending from the outer flange portion at a second angle with respect to the radial plane, and wherein the first face is axially inward from the second face with respect to the core, and wherein the first angle is greater than the second angle.

15. The reel of claim 14, wherein the second angle is substantially zero.

16. The flange of claim 11 wherein each of the radially inward extending ridge and the radially outward extending ridge has a wedge-shaped cross section.

17. The reel of claim 11 wherein the first flange is constructed of molded plastic.

18. The reel of claim 11 wherein the inner section and the outer section are integrally formed.

19. The reel of claim 11 wherein the inner section and the outer section comprise separate components.

20. A method of manufacturing a reel for supporting wound flexible media, the reel including a core having a first pliable end, the first pliable end defining a first cross-sectional shape, the method comprising:

a) disposing at least a portion of a first flange on a support, the first flange having an outer section and an inner section, the outer section including an inner rim, the inner rim including a radially inward extending ridge defining at least a portion of a first periphery corresponding substantially to the first cross-sectional shape, and the inner section including an outer rim, the outer rim including a radially outward extending ridge defining at least a portion of a second periphery corresponding substantially to the first cross-sectional shape;

b) advancing the core past the radially outward extending ridge and the radially inward extending ridge such that at least one of the radially outward extending ridge and the radially inward extending ridge deformingly engage the first pliable end; and c) securing a second flange to the core.

21. The method of claim 20 wherein steps b and c are performed contemporaneously.

22. The method of claim 20 further comprising the step of, prior to step a, injection molding the first flange.

23. The method of claim 20 wherein step b) further comprises advancing the first pliable end past the radially inward extending edge; and inserting the inner section of the first flange into the core such that the first pliable end is advanced past the radially outward extending edge.

24. The method of claim 20 wherein step c) further comprises securing the second flange to the core wherein the second flange has a second flange outer section and a second flange inner section, the second flange outer section including a second flange inner rim, the second flange inner rim including a radially inward extending ridge having a periphery corresponding substantially to the first cross-sectional shape, and the second flange inner section including a second flange outer rim, the second flange outer rim including a radially outward extending ridge having a periphery corresponding substantially to the first cross-sectional shape.

25. A method of manufacturing a reel for supporting wound flexible media, the reel including a core having a first pliable end, the first pliable end defining a first cross-sectional shape, the reel further including a first flange, the first flange having an outer section and an inner section, the outer section including an inner rim, the inner rim including a radially inward extending ridge defining at least a portion of a first periphery corresponding substantially to the first cross-sectional shape, and the inner section includes an outer rim, the outer rim including a radially outward extending ridge defining at least a portion of a second periphery corresponding to the first cross-sectional shape, the method comprising:

a) advancing the core past the radially outward extending ridge and the radially inward extending ridge such that at least one of the radially outward extending ridge and the radially inward extending ridge deformingly engage the first pliable end; and b) securing a second flange to the core.

26. The method of claim 25 wherein step a) further comprises advancing the first pliable end past the radially inward extending edge; and inserting the inner section of the first flange into the core such that the first pliable end is advanced past the radially outward extending edge.

* * * * *